United States Patent [19]

Hale

[11] Patent Number: 4,484,102

[45] Date of Patent: Nov. 20, 1984

[54] STRENGTHENING MEANS FOR A DEEP-DRAWN IN-LINE ELECTRON GUN ELECTRODE

[75] Inventor: John R. Hale, Lancaster, Pa.

[73] Assignee: RCA Corporation, New York, N.Y.

[21] Appl. No.: 353,980

[22] Filed: Mar. 2, 1982

[51] Int. Cl.[3] ..... H01J 29/50; H01J 29/46

[52] U.S. Cl. ..... 313/417; 313/456

[58] Field of Search ..... 313/417, 446–451, 313/414, 456, 457

[56] References Cited

U.S. PATENT DOCUMENTS

| | | | |
|---|---|---|---|
| 2,942,128 | 6/1960 | Johnson | 313/82 |
| 3,659,133 | 4/1972 | Tsuneta et al. | 313/417 |
| 3,873,879 | 3/1975 | Hughes | 315/13 |
| 4,049,990 | 9/1977 | Collins | 313/417 |
| 4,049,991 | 9/1977 | Collins | 313/417 |
| 4,119,884 | 10/1978 | Blumenberg et al. | 313/417 |

FOREIGN PATENT DOCUMENTS

| | | | |
|---|---|---|---|
| 3003197 | 8/1981 | Fed. Rep. of Germany | 313/417 |

OTHER PUBLICATIONS

Soviet Inventor's Certificate No. 924302, Sep. 5, 1980--Cited in Russia.

*Primary Examiner*—Palmer Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

An electron gun assembly includes a plurality of cathode assemblies and a plurality of spaced successive electrodes mounted on at least two electrically-insulating support rods. At least one of the electrodes comprises a deep-drawn substantially rectangular cup-shaped member having a base portion, a supporting flange portion, including a plurality of attachment tabs, and a sidewall extending between said base portion and said supporting flange. The sidewall includes a substantially wedge-shaped shoulder on each of the opposed side thereof that projects outwardly at an acute angle of about 45 degrees from the sidewall. The shoulders extend into the supporting flange adjacent to the attachment tabs. The shoulders form a gusset on each of the opposed sides of the cup-shaped member thereby increasing the structural rigidity of the member.

4 Claims, 5 Drawing Figures

STRENGTHENING MEANS FOR A DEEP-DRAWN IN-LINE ELECTRON GUN ELECTRODE

BACKGROUND OF THE INVENTION

The present invention relates to an in-line electron gun assembly of a plural beam cathode-ray tube and particularly to a ruggedizing improvement in an electrode member for such a gun assembly.

The electrode members of an in-line electron gun assembly are serially arranged to accelerate and focus a plurality of electron beams along spaced, co-planar electron beam paths. The electrode members of the gun assembly are mechanically secured by means of attachment tabs to at least a pair of insulative support rods which extend along the beam paths. Each of the electrode members commonly has several spatially-related apertures formed therein to accommodate the respective electron beams generated within the electron gun assembly. It is important that these several apertures be accurately located and aligned relative to the related apertures in adjacent electrode members, and to the respective electron generating surfaces. During the fabrication of the electron gun assembly, the attachment tabs of the various electrode members are embedded into the temporarily heat-softened insulative support rods; at which time the support rods on opposed sides of the gun assembly are pressured inwardly toward the electrode members to force the attachment tabs into the support rods. The compressive pressure tends to exert a distorting force upon the several electrode members wherein a bowing or "oil canning" effect sometimes occurs. Such bowing, however slight, changes the aperture locations relative to those in the adjacent electrode members, thereby producing deleterious inter-electrode spacing relationships within the gun assembly. The inter-electrode spacing between adjacent electrode members also can be affected by external forces acting unequally on one of the members. A getter assembly, e.g., attached to the most remote member of the electron gun assembly, may cause a variation in the inter-electrode spacing between the getter carrying member and the adjacent electrode member. Such a getter assembly is shown in the prior art structure of FIGS. 1 and 2.

A structure for ruggedizing planar electrode members which are commonly used as the control and screen grid electrodes of an electron gun assembly is disclosed in U.S. Pat. Nos. 4,049,990 and in 4,049,991. Both patents were issued to F. K. Collins on Sept. 20, 1977. In the Collins' patents, intersecting rib-like embossments are formed along the sides of the support surface of planar electrodes with at least one of the ribs extending into an attachment tab. Such a structure strengthens the supporting surface or flange portion of a planar electrode. However, such a structure provides no strengthening of the sidewall of the deep-drawn substantially cup-shaped electrode members such as the focusing and accelerating electrodes of the electron gun assembly.

SUMMARY OF THE INVENTION

An electron gun assembly includes means for generating and directing a plurality of electron beams along spaced, co-planar beam paths. The generating and directing means are spaced along a plurality of insulative support means and include at least one substantially cup-shaped member. The cup-shaped member has a base portion, a supporting flange portion including attachment means to facilitate securing the cup-shaped member to the insulative support means, and a sidewall extending between the base portion and the supporting flange portion. The sidewall includes strengthening means formed therein and projecting outwardly at an acute angle therefrom and extending into the supporting flange portion of said cup-shaped member adjacent to the attachment means for increasing the structural rigidity of the cup-shaped member.

DETAILED DESCRIPTION OF THE PREFERRED EMBODIMENT

Figure 2:
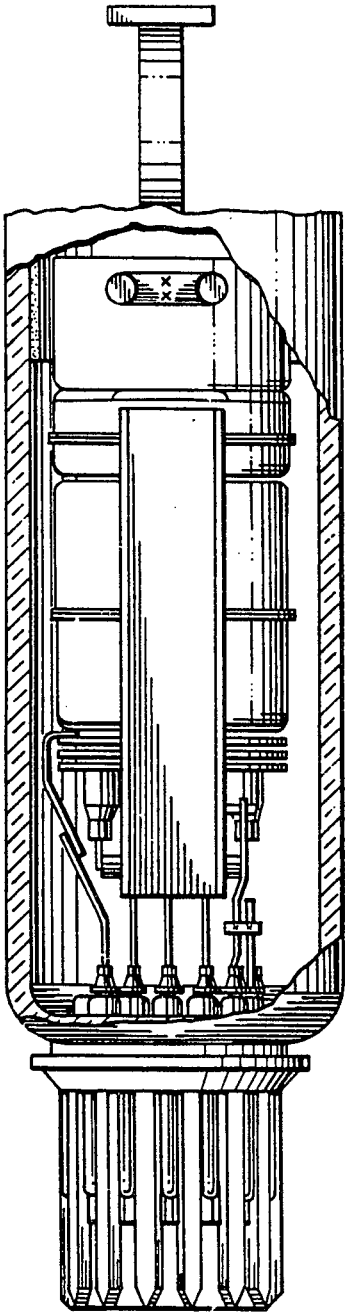
Fig. 2 PRIOR ART
FIG. 2 is a broken-away, side elevational view along section line 2—2 of the electron gun assembly shown in FIG. 1.
Figure 1:
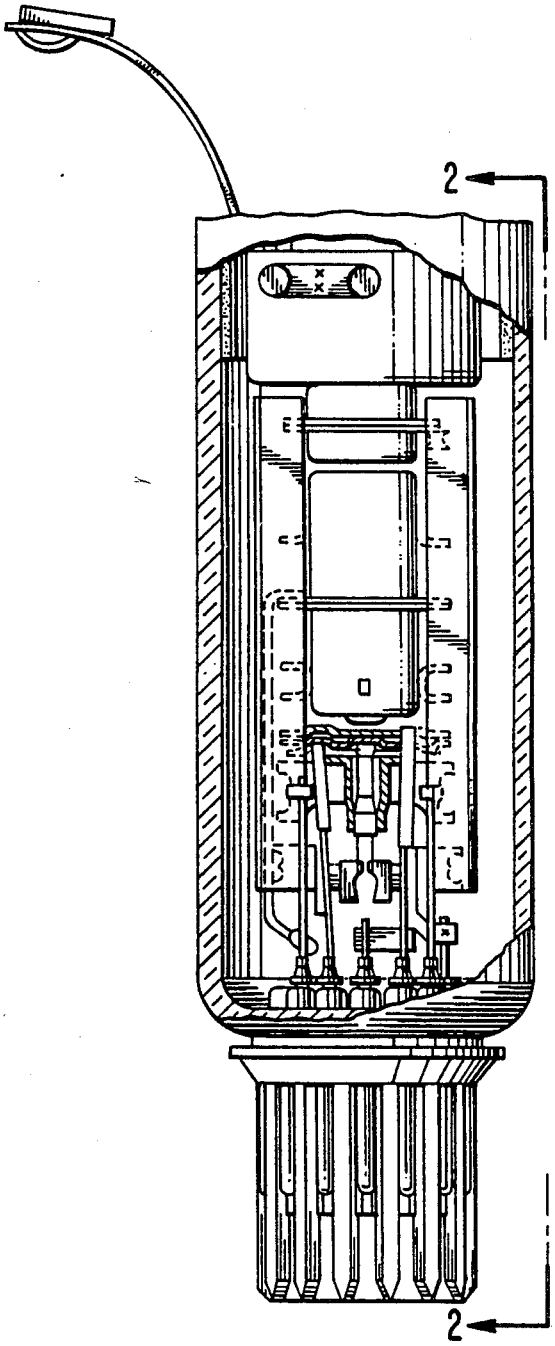
Fig. 1 PRIOR ART
FIG. 1 is a broken-away, front elevational view of a prior art electron gun assembly.

FIGS. 1 and 2 show structural details of a prior art electron gun assembly mounted in the neck of a cathode-ray tube, CRT. The structure of this electron gun assembly is similar to the electron gun assembly described in U.S. Pat. No. 3,873,879 issued to R. H. Hughes on Mar. 25, 1975; however, the deep-drawn electrodes in the Hughes structure are conventional. The Hughes patent, assigned to the same assignee as the present patent application, is incorporated herein for the purpose of disclosure.

Figure 3:
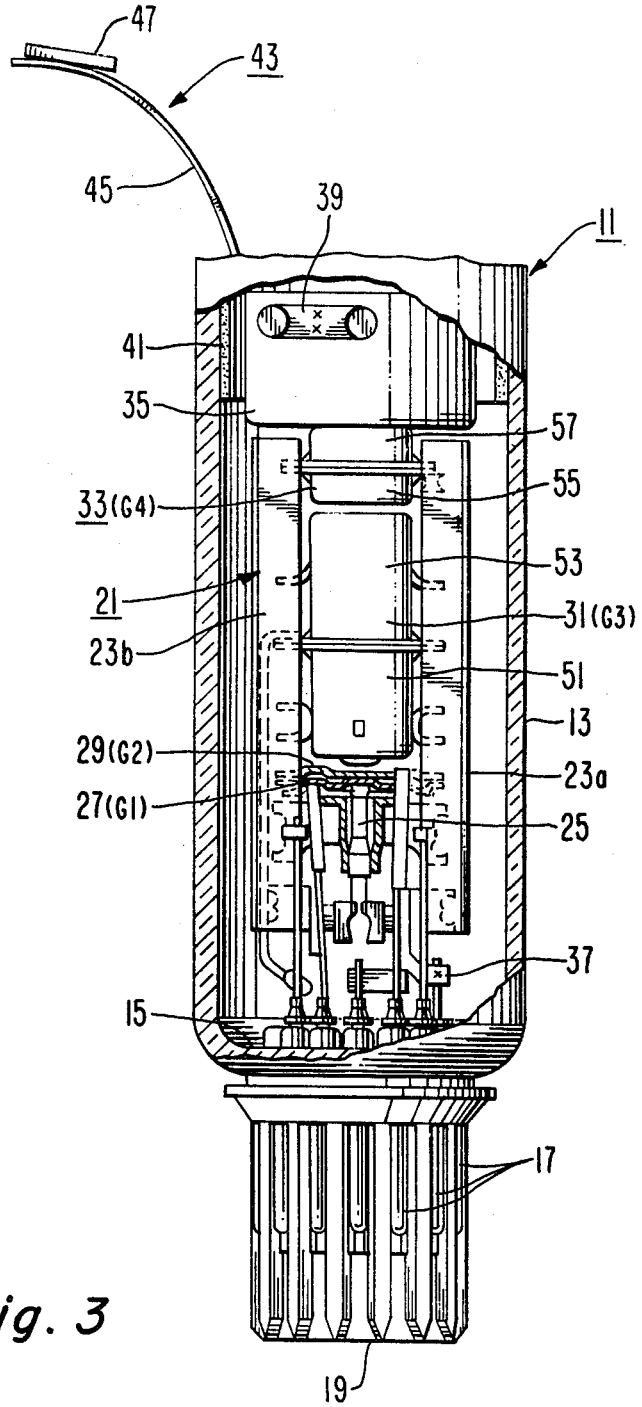
FIG. 3 is a broken-away, front elevational view of an electron gun assembly incorporating a plurality of novel deep-drawn electrodes.

An improved electron gun assembly, shown in FIG. 3, includes an evacuated glass envelope 11, which in a complete CRT includes a rectangular faceplate panel and a funnel having a neck 13 integrally attached thereto. A glass stem 15 having a plurality of leads or pins 17 extending therethrough is sealed to and closes the end of the neck 13. A base 19 is attached to the pins 17 outside the envelope 11.

An in-line electron gun assembly 21, centrally mounted within the neck 13, is designed to generate and direct three electron beams along spaced, co-planar convergent paths having a common, generally longitudinal direction toward the viewing screen. The gun assembly comprises two glass support rods **23*a* and 23*b* from which the various electrodes are supported to form a coherent unit in a manner commonly used in the art. These electrodes include three substantially equally transversely-spaced co-planar cathodes 25 (one for producing each beam), a control-grid electrode 27 (also referred to as G1), a screen-grid electrode 29 (also referred to as G2), a first accelerating and focusing electrode 31 (also referred to as G3), a second accelerating and focusing electrode 33 (also referred to as G4), and a shield cup 35, longitudinally-spaced in that order along the rods 23*a* and 23*b*. The various electrodes of the gun assembly 21 are electrically connected to the pins 17 either directly or through metal ribbons 37. The gun assembly 21 is held in a predetermined position in the neck 13 on the pins 17 and with snubbers 39 on the shield cup 35 which press on and make contact with an electrically conducting internal coating 41 on the inside surface of the neck 13. The internal coating 41 extends over the inside surface of the funnel and connects to the anode button (not shown). A getter assembly 43 comprises an elongated spring 45 which is attached at one end to the cup 35 and extends in cantilever fashion in the funnel of the envelope 11. A metal getter container 47 is attached to the other extended end of the spring 45**.

Figure 4:
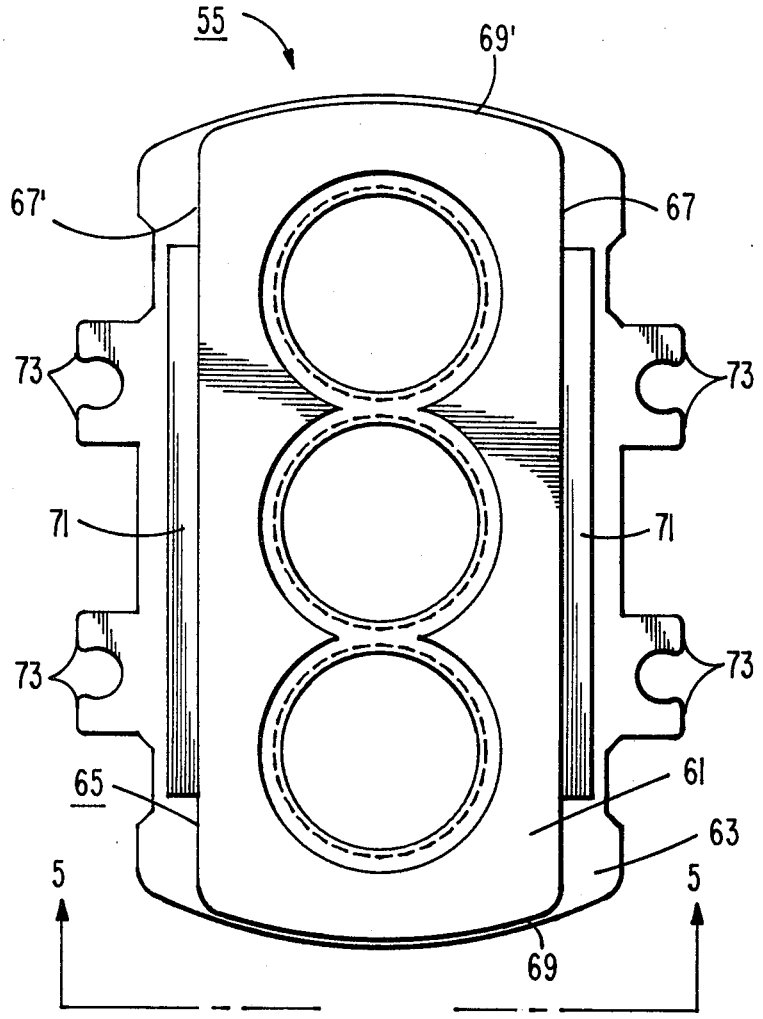
FIG. 4 is a plan view of one of the novel electrodes shown in FIG. 3.
Figure 5:
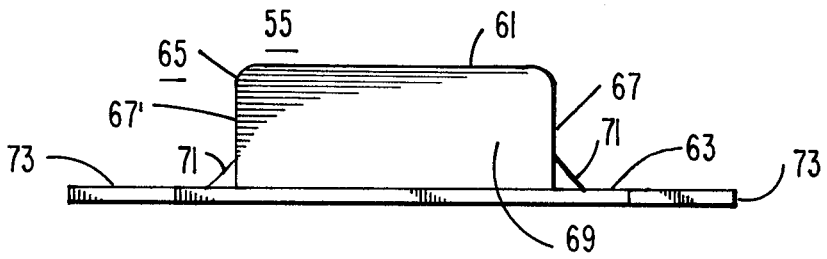
FIG. 5 is a side view along section line 5—5 of FIG. 4.

Electrode 31 comprises first and second substantially rectangular cup-shaped members 51 and 53, respectively, while electrode 33 comprises first and second substantially rectangular cup-shaped members 55 and 57, respectively. The cup-shaped members are joined together at their open ends. One of the cup-shaped members 55 is shown in FIGS. 4 and 5. The electrode member 55 comprises a base portion 61 and a supporting flange portion 63 that is substantially parallel to the plane of the base portion 61. A sidewall 65, generally orthogonal to the plane of the base portion 61 extends between the base portion 61 and the supporting flange portion 63. The sidewall 65 has opposed sides 67 and 67' and opposed end portions 69 and 69'. A substantially wedge-shaped shoulder 71 is formed in and projects outwardly at an acute angle of about 45 degrees from each of the opposed sides 67 and 67' of the sidewall 65. The shoulder 71 extends into the supporting flange 63. The supporting flange portion 63 of the cup-shaped member 55 includes a plurality of attachment tabs 73 projecting outwardly from the opposed sides of the flange portion 63 to facilitate securing the cup-shaped member 55 to the support rods 23*a* and 23*b*, respectively. The attachment tabs 73 are grouped in claw-like pairs to maximize the securing force between the cup-like member 55 and the support rods 23*a* and 23*b*. The shoulder 71 forms a gusset between the sidewall 65 and the support flange 63 adjacent to the attachment tabs 73 to reinforce the cup-shaped member 55 and increase its structural rigidity. While the improvement comprising the ruggedizing and strengthening shoulder 71 is described above in terms of a gusset formed in the opposed sides and supporting flange of the cup-shaped member 55, it is also desirable to form similar gussets in each of the other cup-shaped members 51, 53 and 57 to increase the structural rigidity of each of these other cup-shaped members. Also, it should be clear to one skilled in the art, that alternatively, a plurality of smaller gussets extending between the sidewall and the support flange adjacent to attachment tabs 73 could be formed in each of the cup-shaped members 51, 53, 55 and 57.

What is claimed is:

1. In an electron gun assembly having means for generating and directing a plurality of electron beams along spaced, co-planar beam paths, said generating and directing means being spaced along a plurality of insulative support means, said generating and directing means including at least one substantially cup-shaped member having a base portion, a supporting flange portion substantially parallel to said base portion and a sidewall extending therebetween, said supporting flange portion including attachment means to facilitate securing said member to said insulative support means, the improvement wherein said sidewall includes strengthening means formed therein and projecting outwardly at an acute angle therefrom and extending into said supporting flange portion of said cup-shaped member adjacent to said attachment means for increasing the structural rigidity of said member.

2. In an evacuated envelope including an in-line electron gun assembly having means for generating and directing a plurality of electron beams along spaced, co-planar beam paths, said generating and directing means being spaced along a plurality of insulative support means, said generating and directing means including at least one substantially rectangularly cup-shaped member, said cup-shaped member having a base portion, a supporting flange portion substantially parallel to said base portion, and a sidewall having opposed sides and end portions extending between said base portion and said supporting flange portion, said supporting flange portion including attachment means projecting outwardly therefrom, said attachment means being adjacent to each of said opposed sides of said sidewall to facilitate securing said cup-shaped member to said insulative support means, the improvement wherein said sidewall includes at least one protuberance formed therein and projecting outwardly at an acute angle from each of said opposed sides thereof, said protuberance extending into said supporting flange adjacent to said attachment means thereby forming at least one gusset on each of said opposed sides of said cup-shaped member thereby increasing the structural rigidity of said member.

3. In an in-line electron gun assembly, said gun assembly including a plurality of cathode assemblies and a plurality of spaced successive electrodes mounted on at least two electrically-insulating support rods, at least one of said electrodes comprising a deep-drawn substantially rectangular cup-shaped member having a base portion, a supporting flange portion substantially parallel to the plane of said base portion, and a sidewall having opposed sides and end portions extending between said base portion and said supporting flange portion, said sidewall being generally orthogonal to the plane of said base portion, said supporting flange portion including a plurality of attachment tabs projecting outwardly therefrom, said tabs being adjacent to each of said opposed sides of said sidewall for securing said cup-shaped member to said insulating support rods, the improvement wherein said sidewall includes at least one protuberance formed therein and projecting outwardly at an acute angle of about 45 degrees from each of said opposed sides thereof, said protuberance extending into said supporting flange adjacent to said attachment tabs thereby forming at least one gusset on each of said opposed sides of said cup-shaped member thereby increasing the structural rigidity of said member.

4. The gun as in claims 2 or 3 wherein said protuberance comprises a substantially wedge-shaped shoulder, said protuberance being formed in said sidewall proximate to said supporting flange.

* * * * *